US009110431B2

(12) United States Patent
Fukuda

(10) Patent No.: US 9,110,431 B2
(45) Date of Patent: Aug. 18, 2015

(54) IMAGE FORMING APPARATUS

(71) Applicant: CANON KABUSHIKI KAISHA, Tokyo (JP)

(72) Inventor: Tadashi Fukuda, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/975,773

(22) Filed: Aug. 26, 2013

(65) Prior Publication Data

US 2014/0064811 A1 Mar. 6, 2014

(30) Foreign Application Priority Data

Aug. 31, 2012 (JP) ..... 2012-191945

(51) Int. Cl.
*G03G 21/00* (2006.01)
*G03G 15/02* (2006.01)

(52) U.S. Cl.
CPC ..... *G03G 21/0011* (2013.01); *G03G 15/0291* (2013.01); *G03G 21/0005* (2013.01); *G03G 2221/0015* (2013.01); *G03G 2221/0042* (2013.01)

(58) Field of Classification Search
CPC ..... G03G 21/0005; G03G 21/0011; G03G 21/0076; G03G 21/0082; G03G 2221/001; G03G 2221/0015; G03G 2221/0026; G03G 2221/0042
USPC ..... 399/349–351
See application file for complete search history.

(56) References Cited

U.S. PATENT DOCUMENTS

| | | | | |
|---|---|---|---|---|
| RE34,384 | E * | 9/1993 | Ishiguro et al. | 399/102 |
| 5,321,473 | A * | 6/1994 | Azami | 399/103 |
| 5,455,665 | A * | 10/1995 | Baba et al. | 399/358 |
| 5,475,467 | A * | 12/1995 | Watanabe et al. | 399/111 |
| 5,697,021 | A * | 12/1997 | Watanabe et al. | 399/102 |
| 6,272,300 | B1 * | 8/2001 | Fujiwara et al. | 399/113 |
| 6,640,081 | B2 * | 10/2003 | Sato | 399/350 |
| 6,658,223 | B2 * | 12/2003 | Nishimura et al. | 399/102 |
| 7,236,727 | B2 | 6/2007 | Fukuda | |
| 7,885,578 | B2 * | 2/2011 | Yoshino | 399/171 |
| 7,885,594 | B2 * | 2/2011 | Fujii | 399/343 |
| 8,554,112 | B2 * | 10/2013 | Kidaka | 399/170 |
| 2009/0317124 | A1 * | 12/2009 | Iwamoto et al. | 399/102 |
| 2010/0158550 | A1 | 6/2010 | Makino et al. | |
| 2011/0206395 | A1 | 8/2011 | Tanaka et al. | |
| 2011/0243584 | A1 | 10/2011 | Fukuda | |
| 2011/0262161 | A1 | 10/2011 | Fukuda et al. | |
| 2012/0106991 | A1 | 5/2012 | Fukuda et al. | |
| 2013/0051840 | A1 * | 2/2013 | Yamamoto et al. | 399/102 |
| 2013/0315643 | A1 * | 11/2013 | Wakayama | 399/350 |

FOREIGN PATENT DOCUMENTS

EP 2 199 870 A1 6/2010

* cited by examiner

*Primary Examiner* — David Gray
*Assistant Examiner* — Carla Therrien
(74) *Attorney, Agent, or Firm* — Fitzpatrick, Cella, Harper & Scinto

(57) ABSTRACT

An image forming apparatus includes a charger having a case surrounding a discharge electrode, an opening on the photosensitive member side and a grid disposed in the opening and having a mesh area, a shutter that covers the opening, and first and second contact members. The contact members are disposed on a downstream side of the charger and an upstream side of a cleaning blade in a rotational direction of the photosensitive member and come in contact with areas of the photosensitive member corresponding to both longitudinal ends of the mesh area of the grid.

7 Claims, 14 Drawing Sheets

FIG. 12A

| | | TIME (ms) | | | | |
|---|---|---|---|---|---|---|
| | | 50 | 100 | 150 | 200 | 250 |
| POTENTIAL DIFFERENCE (V) | 500 | 0.5 | 1 | 1.5 | 2 | 2.5 |
| | 250 | 0.25 | 0.5 | 0.75 | 1 | 1.25 |
| | 100 | 0.1 | 0.2 | 0.3 | 0.4 | 0.5 |

FIG. 12B

| NUMBER OF CHARGER SHUTTER OPENING AND CLOSING | 0 | 30 | 90 | 150 | 210 | 270 | 300 | 330 | 390 |
|---|---|---|---|---|---|---|---|---|---|
| NUMBER OF OCCURRING NAPS | 0 | 32 | 99 | 142 | 221 | 289 | 331 | 345 | 401 |
| NAP AVERAGE SIZE ( $\mu$m) | 0 | 34 | 42 | 52 | 89 | 110 | 120 | 134 | 150 |
| IMAGE STREAK : CONVENTIONAL EXAMPLE | ○ | ○ | ○ | △ | × | × | × | × | × |
| IMAGE STREAK: EMBODIMENT 1 | ○ | ○ | ○ | ○ | ○ | ○ | ○ | △ | △ |
| IMAGE STREAK: EMBODIMENT 2 | ○ | ○ | ○ | ○ | ○ | ○ | ○ | ○ | ○ |
| SURFACE STATE OF END PORTION : CONVENTIONAL EXAMPLE | ○ | ○ | △ | × | × | × | × | × | × |
| SURFACE STATE OF END PORTION : EMBODIMENT 1 | ○ | ○ | ○ | ○ | ○ | ○ | △ | △ | △ |
| SURFACE STATE OF END PORTION : EMBODIMENT 2 | ○ | ○ | ○ | ○ | ○ | ○ | ○ | △ | △ |

IMAGE FORMING APPARATUS

BACKGROUND OF THE INVENTION

1. Field of the Invention

The present invention relates to an image forming apparatus such as a copying machine, a printer, and a facsimile.

2. Description of the Related Art

An electrophotographic system image forming apparatus in which a photosensitive member is charged by a corona charger has been known. Particularly, a product using a corona charger called a scorotron provided with a grid to stabilize a charging potential of the photosensitive member has been known. An etching grid in which a mesh area having a plurality of holes in a thin flat plate as a grid is formed by etching has been known. When corona discharge occurs in the air according to the use of the corona charger, discharge products (ozone, nitrogen oxide, and the like) occur. When the discharge products are attached to and laminated on the photosensitive member and are moisture-absorbed under a high-humidity environment, the discharge products cause an image defect called image deletion.

In U.S. Patent Application Publication No. 2010/0158550 A1, an opening portion opposed to a photosensitive drum of a corona charger is covered with a shutter. Specifically, a carriage which supports an end portion of a sheet-shape shutter is moved in an opening longitudinal direction, and an opening of the corona charger is covered at the time of non-image forming to suppress attachment of discharge products to a photosensitive drum.

Since it is possible to efficiently charge the photosensitive member by the corona discharge, a distance between the corona charger and the photosensitive member can be short. For this reason, there are many cases in which the shutter interposed between the corona charger and the photosensitive member has a thin sheet shape. In addition, in order to wind and store the shutter, it is preferable to use a soft material such as a nonwoven fabric obtained by processing a fiber.

However, in the charger provided with the etching grid, when the shutter including the fiber such as the nonwoven fabric obtained by processing a fiber is repeatedly used, the shutter surface becomes rough by contact sliding to longitudinal both end portions of the mesh area in the etching grid adjacent to the shutter, and thus a nap occurs. The nap occurring on the shutter surface drops onto the drum at the time of shutter opening and closing operation.

The nap dropping onto the photosensitive member is conveyed by driving of the photosensitive member, and may be conveyed even to a cleaning unit of the photosensitive member. When the cleaning unit of the photosensitive member is a cleaner blade, the nap is caught at a contact portion of the cleaner blade and the photosensitive member, and a cleaning defect occurs based on the caught nap.

SUMMARY OF THE INVENTION

It is desirable to provide an image forming apparatus capable of suppressing a nap or the like occurring by sliding of a shutter including a fiber opening and closing an opening provided on a photosensitive member side of a case surrounding a discharge electrode in a charger against both longitudinal end portions of a mesh area in an etching grid is caught at a cleaner blade of the photosensitive member, to suppress occurrence of a cleaning defect. Other objects of the invention will be clarified by reading the following detailed description with reference to the attached drawings.

Further features of the present invention will become apparent from the following description of exemplary embodiments with reference to the attached drawings.

BRIEF DESCRIPTION OF THE DRAWINGS

FIG. 12A is a table of determining timings of a high development voltage, driving of a development sleeve 4*a*, and a high charging voltage in the second embodiment. FIG. 12B is a diagram illustrating naps with respect to the number of opening and closing times of a shutter and endurance transition of a cleaning defect and an image defect based on the naps in a conventional example, and the first and second embodiments.

DESCRIPTION OF THE EMBODIMENTS

Figure 1A:
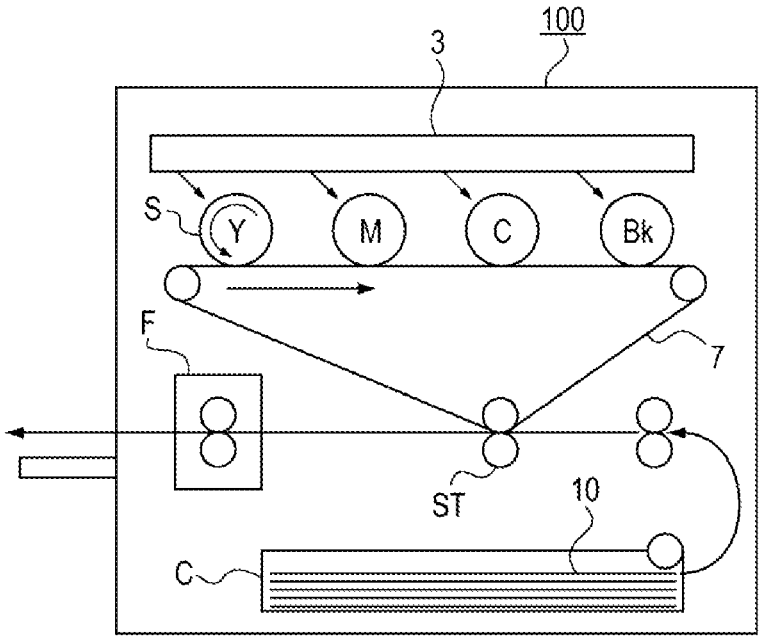
FIG. 1A is a diagram illustrating a configuration of an image forming apparatus according to a first embodiment.

[First Embodiment] An image forming apparatus according to a first embodiment of the invention will be described with reference to the drawings. FIG. 1A is a diagram illustrating a configuration of an image forming apparatus 100 according to the embodiment. As illustrated in FIG. 1A, the image forming apparatus 100 includes stations (image forming portions) S (Y to Bk) of yellow (Y), magenta (M), cyan (C), and black (Bk).

Figure 1B:
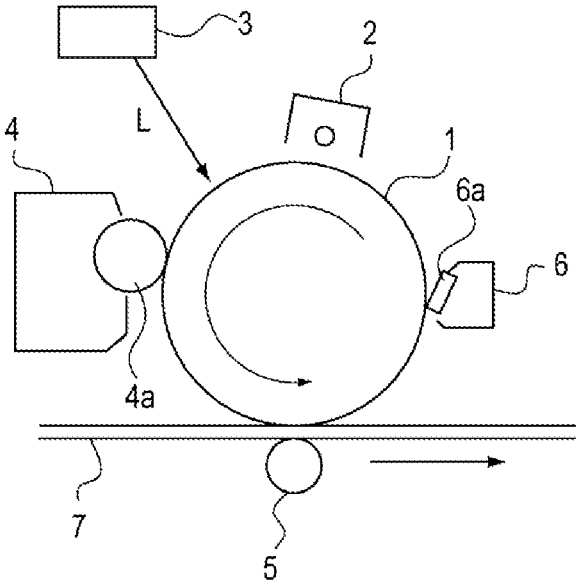
FIG. 1B is a diagram illustrating a configuration of an image forming portion.

FIG. 1B is a diagram illustrating a configuration of the station (the image forming portion) S. As illustrated in FIG. 1B, in each station S, a photosensitive drum (an image bearing member) 1 serving as a photosensitive member is charged by a corona charger (a charging device) 2, and is exposed to laser light corresponding to image information from a laser scanner 3 serving as an exposure device, to form an electrostatic latent image. The electrostatic latent image formed on the photosensitive drum 1 (on the image bearing member) is developed as a toner image of each color by each color toner accommodated in a developing device 4 serving as a developing device.

The developed toner image of each color is repeatedly transferred to an intermediate transfer belt (an intermediate transfer member) 7 by a transfer roller (a transfer member) 5 serving as a transfer device. After the transferring, remaining transfer toner which is not transferred to the intermediate transfer belt 7 and remains on the photosensitive drum 1 is cleaned by a cleaning device 6.

The toner image transferred to the intermediate transfer belt 7 is transferred to a recording material 10 conveyed from a cassette 8 at a secondary transfer portion ST. Remaining transfer toner which is not transferred to the recording material 10 and remains on the intermediate transfer belt 7 is cleaned by a belt cleaner (not illustrated). The recording material 10 to which the toner image is transferred is heated and pressurized by a fixing device F, and the toner image is fixed and discharged out of the device.

Figure 2A:
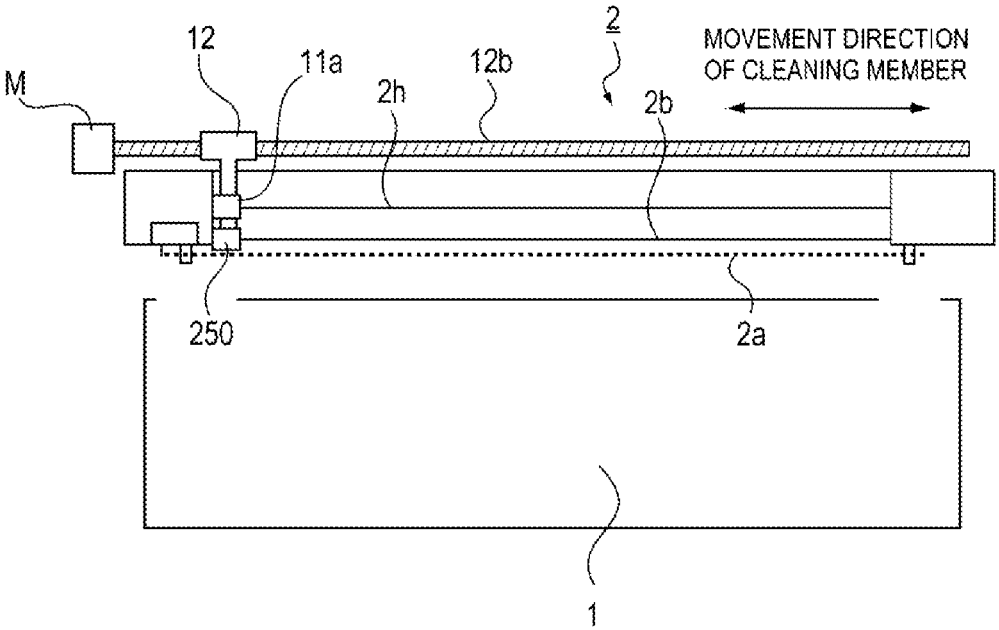
FIG. 2A is a longitudinal cross-sectional view of a corona charger.
Figure 2B:
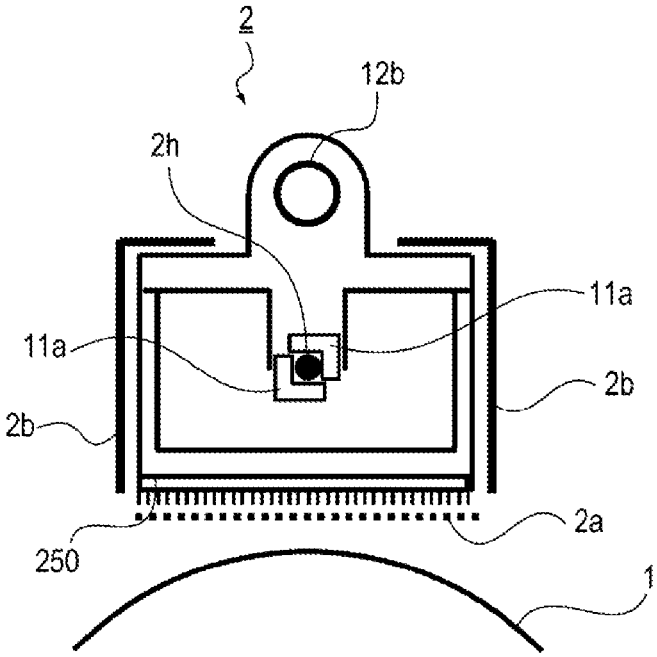
FIG. 2B is a lateral cross-sectional view of the corona charger.
Figure 3:
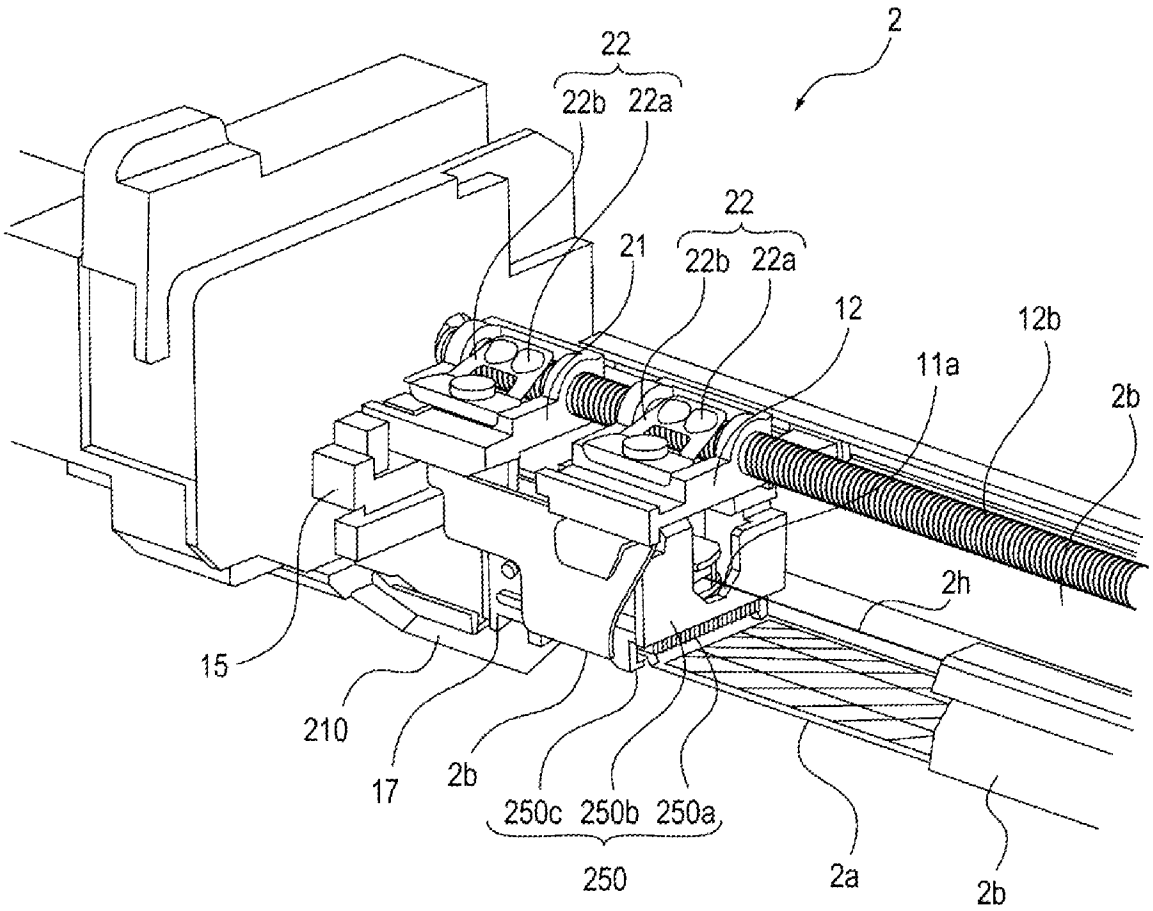
FIG. 3 is a perspective view as viewing a device front side of the corona charger from a unit upside.

(Corona Charger 2) FIG. 2A is a longitudinal cross-sectional view of a corona charger. FIG. 2B is a lateral cross-sectional view of the corona charger 2. FIG. 3 is a perspective view as viewing a device front side of the corona charger from a unit upside. In FIG. 3, a shield 2*b* included in the case is partially notched to see the inside of the corona charger. As illustrated in FIG. 2A, the corona charger 2 is provided along a generating line of the photosensitive drum 1. A longitudinal direction of the corona charger 2 is parallel to an axial direction of the photosensitive drum 1.

As illustrated in FIG. 2B, the corona charger 2 is a scorotron type including a grid (a control electrode) 2*a*, a shield 2*b*, and a discharge wire (a discharge electrode) 2*h*. The grid 2*a* is provided at the opening portion of the case including the shield 2*b* opposed to the photosensitive drum 1. The grid 2*a* is stretched in a longitudinal direction of the corona charger 2 on a side closer to the photosensitive drum 1 (a side of an object to be charged) than the discharge wire 2*h*. In the embodiment, as the grid 2*a*, a flat etching grid is used. The shield 2*b* is provided to surround the discharge wire 2*h*. The discharge wire 2*h* is stretched in the shield 2*b* in the longitudinal direction of the corona charger 2.

High voltages are applied from different high voltage power supplies 18 and 19 (see FIG. 7A) to the grid 2*a* and the discharge wire 2*h*, respectively. By applying a predetermined voltage to the grid 2*a*, current flowing in the photosensitive drum 1 from the discharge wire 2*h* is controlled, and thus it is possible to converge a charging potential of the photosensitive drum 1 to a desired potential.

As illustrated in FIG. 2A and FIG. 2B, the corona charger 2 includes cleaning pads 11*a* and a grid cleaning member 250. The cleaning pads 11*a* are disposed to sandwich the discharge wire 2*h*, and clean the discharge wire 2*h*. The grid cleaning member 250 comes in contact with a face of the grid 2*a* on the discharge wire 2*h* side, and cleans the grid 2*a*.

Figure 4:
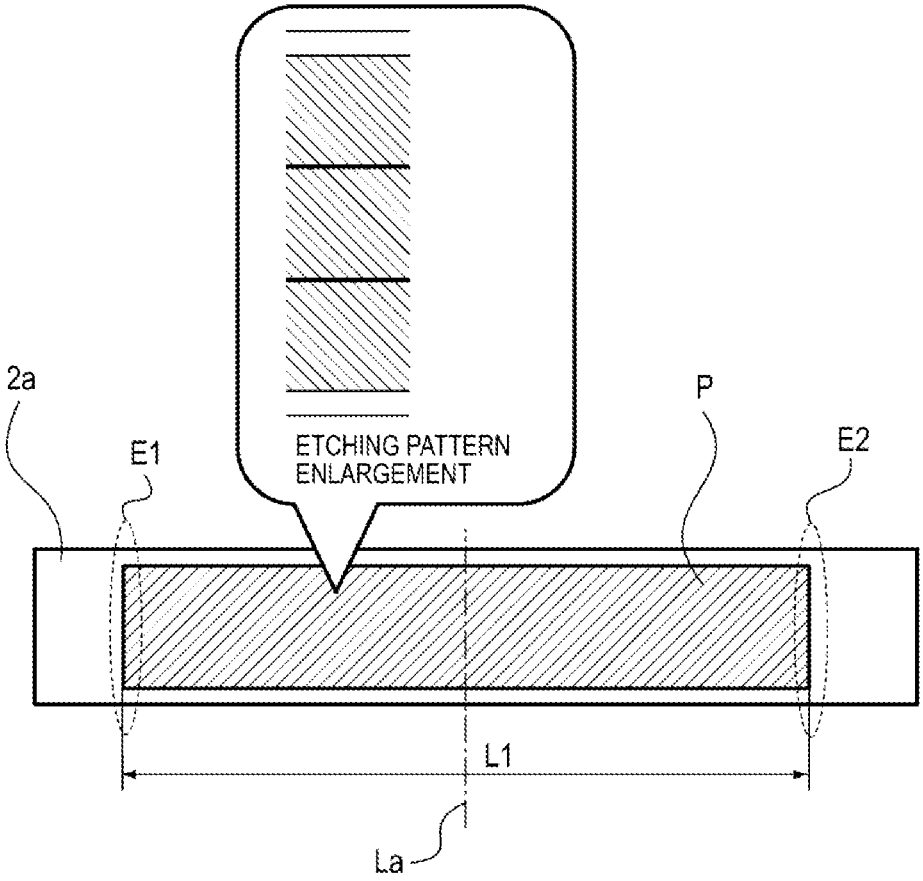
FIG. 4 is a plan view of a grid of the corona charger.

FIG. 4 is a plan view of the grid 2*a*. As illustrated in FIG. 4, an etching pattern area (a pattern area) P that is a mesh area provided with a plurality of voids contributing to charging is formed on the surface of the grid 2*a*. The etching pattern area P is formed by an etching process so as to remain four directions as a frame. Specifically, austenite-based stainless steel that is a substrate has 390 mm in a longitudinal direction and 30 mm in a lateral direction. The etching pattern area P is L1=320 mm in a longitudinal direction and 26 mm in a lateral direction. Boundary portions between the etching pattern area P and the frame in the longitudinal direction are represented by E1 and E2.

An area of the substrate other than the etching pattern area/an area of the etching pattern area P is equal to or less than 40%. Accordingly, it is easy to converge the charging potential. In addition, when an image center La is assumed to be 0 mm, the etching pattern of the grid 2*a* is formed at a position uniformly by each 160 mm to left and right with respect to the image center La. The opening portion of the corona charger 2 is formed of the shield 2*b*, a front block 201, and a rear block 202, and a longitudinal length is 360 mm. The opening portion of the corona charger 2 and the charged area of the photosensitive drum 1 are substantially the same range as that of the etching pattern area P. Here, the charged area of the photosensitive drum 1 is an area corresponding to an immediate downside of the shutter. The etching pattern illustrated in FIG. 4 is an example, and may have another shape.

Figure 5:
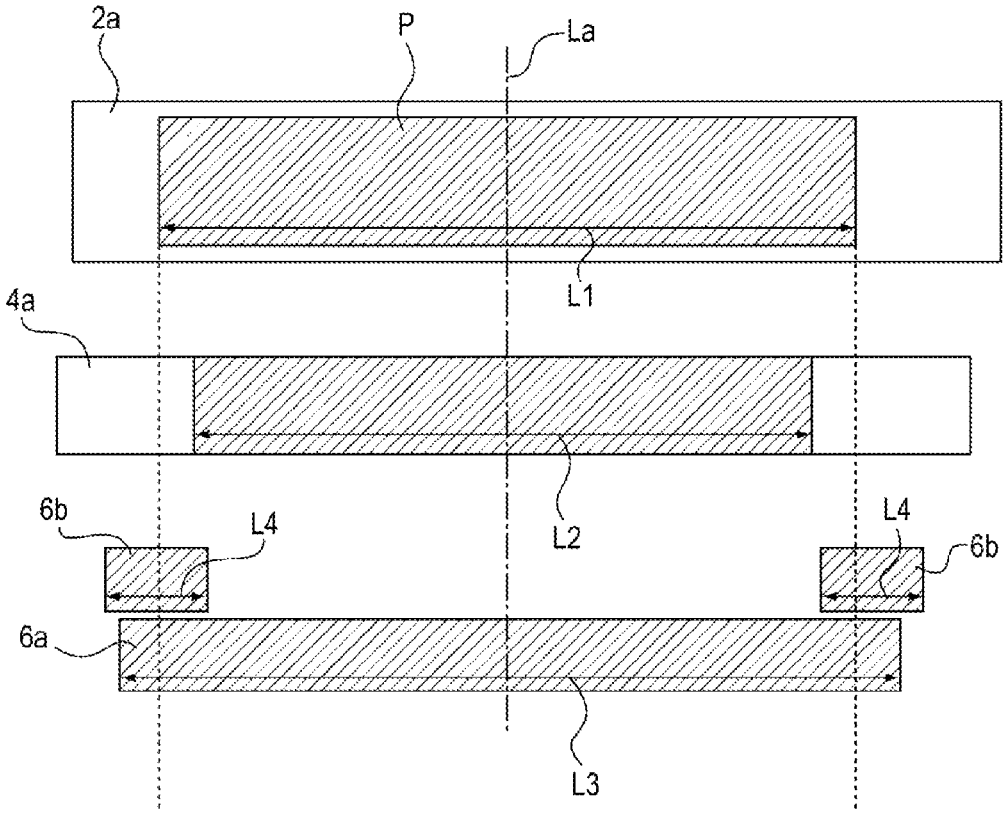
FIG. 5 is a diagram illustrating longitudinal disposition of the grid of the corona charger, a development sleeve of a developing device, and a cleaner blade of a cleaning device.

FIG. 5 is a diagram illustrating longitudinal disposition of a grid 2*a*, a development sleeve (a toner bearing member) 4*a* of the developing device 4 and a cleaner blade (a cleaning member) 6*a* of the cleaning device 6. As illustrated in FIG. 5, the developing device 4 has the development sleeve 4*a* that bears toner, and bears toner in a width of a longitudinal length L2=310 mm, uniformly by each 155 mm to left and right with respect to the image center La.

The cleaning device 6 includes a cleaner blade 6*a*, and first and second end contact members 6*b*. The end contact members 6*b* are disposed at both longitudinal ends of the cleaner blade 6*a*. The end contact members 6*b* are provided at a downstream side in the rotational direction of the photosensitive drum 1 relative to the cleaning member 250 and at a downstream side in the rotational direction of the photosensitive drum 1 relative to the corona charger 2. The end contact members 6*b* come in contact with contact portions provided at both ends of the photosensitive drum 1 with contact pressure lower than contact pressure of the cleaning member 250.

In the embodiment, the contact pressure of the cleaner blade is assumed to be 1,050 g. The cleaner blade 6*a* has a width of a longitudinal length L3=340 mm, uniformly by each 170 mm to left and right with respect to the image center La. The end contact members 6*b* are disposed to the upstream relative to the cleaner blade 6*a* in the rotational direction of the photosensitive drum 1. The end contact members 6*b* are disposed at distances of 150 to 180 mm to left and right from the image center La, in a width of a longitudinal length L4=30 mm.

As a material of the end contact member 6*b*, a pile resin (a pile fiber) including a fluorine fiber is used. The end contact members 6*b* come in infiltration contact with the photosensitive drum 1 by about 1.0 mm, and are disposed to come in contact with a predetermined contact pressure lower than the contact pressure of the cleaner blade 6*a*. In the embodiment, the contact pressure is assumed to be 200 g. In addition, the material of the end contact member may be a material obtained by attaching polyethylene or a urethane resin to a sponge layer, a urethane sponge, nylon, or a rubber material. As described above, the contact pressure of the end contact member 6*b* is lower than the contact pressure of the cleaner blade 6*a*, and thus it is possible to suppress occurrence of scratches although a nap is caught between the photosensitive drum and the end contact member.

Figure 6A:
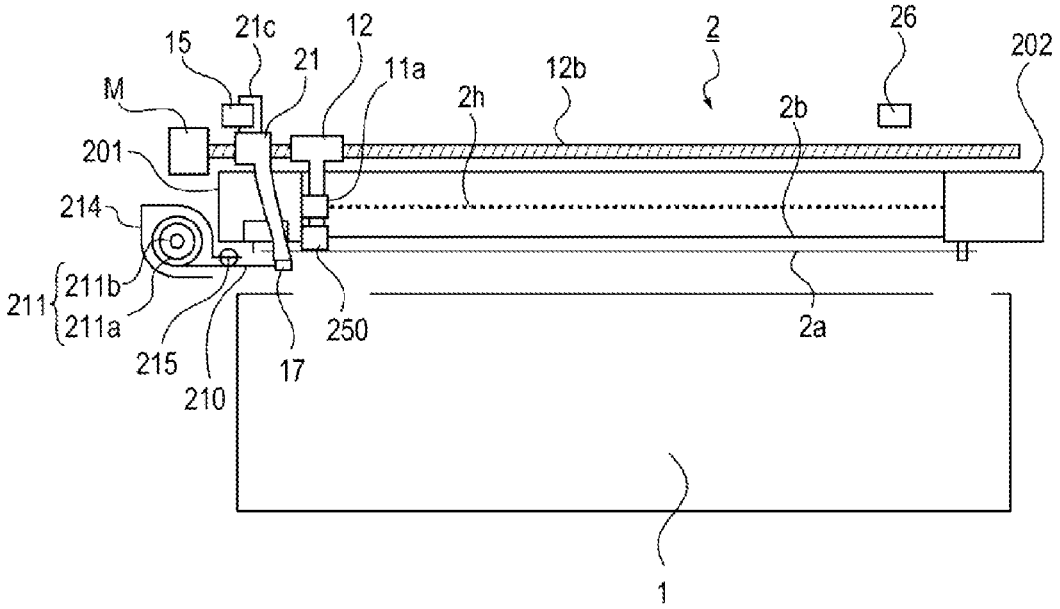
FIG. 6A is a longitudinal cross-sectional view of the corona charger when a shutter is at an opening operation completion position.
Figure 6B:
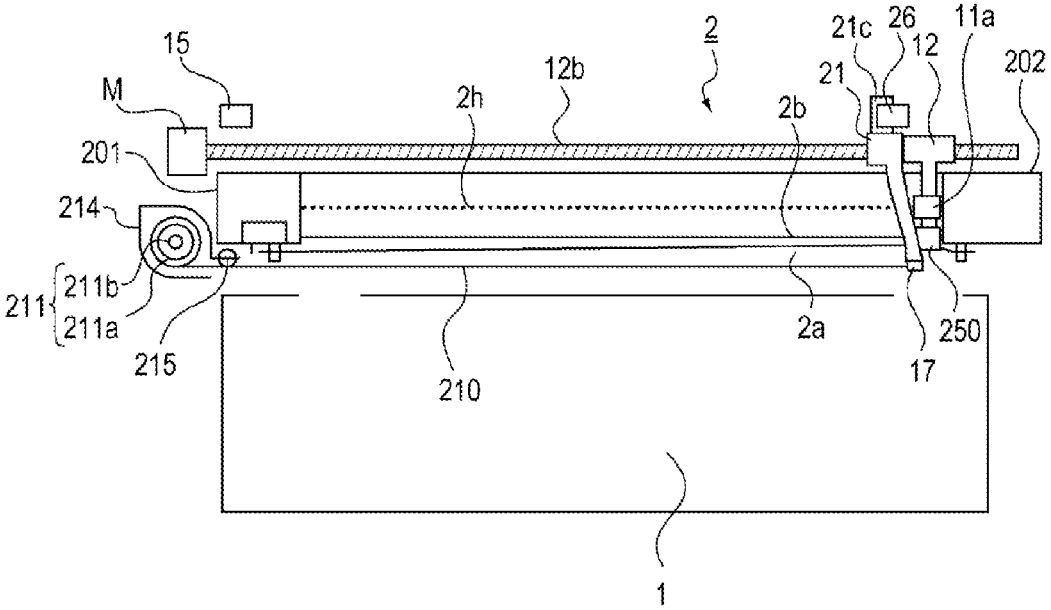
FIG. 6B is a longitudinal cross-sectional view of the corona charger when the shutter is at a closing operation completion position.

(Shutter 210) FIG. 6A is a longitudinal cross-sectional view of a corona charger 2 when the shutter 210 is at an opening operation completion position (a home position). FIG. 6B is a longitudinal cross-sectional view of the corona charger 2 when the shutter 210 is at a closing operation completion position.

As illustrated in FIG. 6A and FIG. 6B, the corona charger 2 includes the shutter 210, a winding mechanism 211, and a housing case 214. The shutter 210 is formed in a sheet shape, and moves a gap between the grid 2*a* and the photosensitive drum 1 to open and close the opening portion of the corona charger 2. In order to efficiently transfer the corona discharge of the discharge wire 2*h* to the photosensitive drum 1, a gap between the photosensitive drum 1 and the grid 2*a* of the charger is 1.5 mm.

The winding mechanism 211 is provided at one end in the longitudinal direction of the corona charger 2, and winds and accommodates the shutter 210 in a roll shape. The winding mechanism 211 includes a roller 211*a* and a torsion coil spring 211*b*. The roller 211*a* fixes one end of the shutter 210. The torsion coil spring 211*b* is provided in the roller 211*a*. A force is applied to the roller 211*a* in a direction of winding the shutter 210 (a direction of opening the opening portion) by the torsion coil spring 211*b*.

The housing case 214 accommodates the winding mechanism 211, and is housed in the front block 201. A guide claw 215 is provided in the vicinity of a shutter drawing portion of the housing case 214. The guide claw 215 guides the shutter 210, and causes the shutter 210 not to come in contact with an edge or the like of the grid 2*a*.

At the other longitudinal end (the opposite side to the winding side) of the shutter 210, a shutter fixing member 17 serving as a fixing member is provided. The shutter fixing member 17 pulls the other end side of the shutter 210. The shutter fixing member 17 has a shape in which a lateral center portion of the shutter 210 further protrudes to the corona charger 2 side than both end portions. The shutter fixing member 17 is detachably attachable to a first moving member 21 included in a moving mechanism. When the first moving member 21 is moved to the back side (a direction of closing the opening portion) by driving from a screw 12*b* included in the moving mechanism provided above the corona charger 2, the shutter 210 is drawn from the winding mechanism 211, to close the opening portion provided on the photosensitive member side of the case. In addition, when the first moving member 21 is moved to the front side (a direction of opening the opening portion), the shutter 210 is wound by the winding mechanism 211 and is accommodated in the housing case 214, and the opening portion is opened.

In the embodiment, the shutter 210 is formed of a nonwoven fabric with a thickness of 30 μm including a rayon fiber. The width of the shutter 210 in the lateral direction (a thrust direction) is more than a width of the shield 2*b*, and is equal to or more than 3 mm in the embodiment. Accordingly, it is prevented that discharge products come around from both lateral end portions of the shutter 210 and drop onto the photosensitive drum 1. In addition, the shutter 210 may be a material obtained by weaving a nylon fiber.

At both end portions in a movable range of the first moving member 21, a shutter opening detecting device 15 and a shutter closing detecting device 26 are provided. The shutter opening detecting device 15 and the shutter closing detecting device 26 have photo-interrupters 15*a* and 26*a* (see FIG. 7A). When the first moving member 21 reaches the opening operation completion position, the photo-interrupter 15*a* is blocked by a light blocking member 21*c*, and the shutter opening detecting device 15 detects opening operation completion of the shutter 210. When the first moving member 21 reaches the closing operation completion position, the photo-interrupter 26*a* is blocked by the light blocking member 21*c*, and the shutter closing detecting device 26 detects closing operation completion of the shutter 210. At the time of detecting the light blocking member 21*c* of the first moving member 21 by the shutter opening detecting device 15 and the shutter closing detecting device 26, rotation of a driving motor M included in the moving mechanism is stopped.

The driving motor M moves the first moving member 21 and the second moving member 12 in the longitudinal direction through the screw 12*b*. The first moving member 21 opens and closes the shutter 210 through the shutter fixing member 17. The second moving member 12 moves the cleaning pad 11*a* and the grid cleaning member 250 to perform cleaning.

In addition, it is not necessary to necessarily provide the shutter opening detecting device 15 and the shutter closing detecting device 26. For example, a time when the first moving member 21 moves between the opening operation completion position and the closing operation completion position is set in advance, the rotation time of the driving motor M is set to the set time, and thus the opening and closing of the shutter 210 may be detected.

Figure 7A:
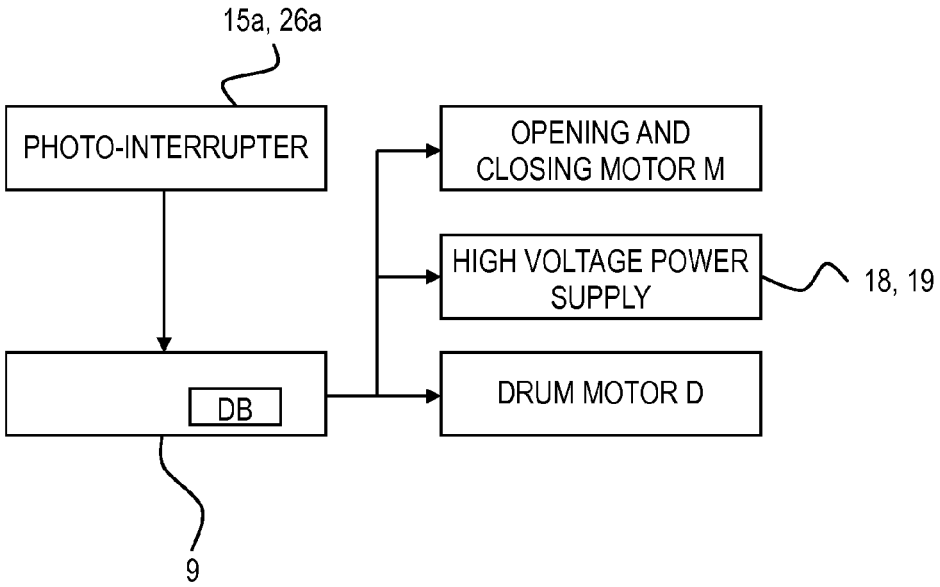
FIG. 7A is a block diagram of a controller.

(Controller) FIG. 7A is a block diagram illustrating a controller. As illustrated in FIG. 7A, a controller 9 includes a CPU, a ROM, and a RAM, and controls the driving motor M, the high voltage power supplies 18 and 19, and a drum motor D according to a program stored in the ROM. In addition, the photo-interrupters 15*a* and 26*a* notifies the controller 9 of whether there is the light blocking member 21*c*.

Figure 7B:
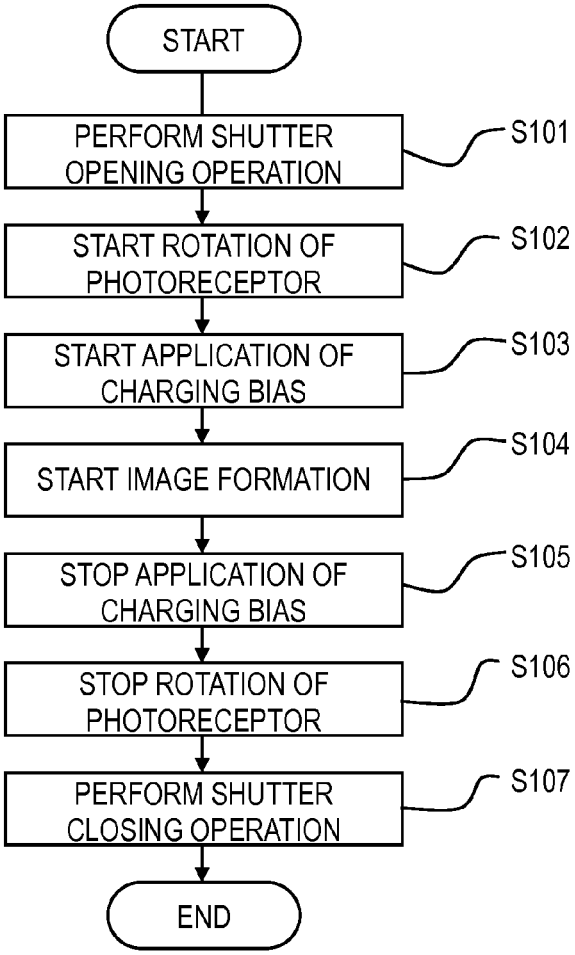
FIG. 7B PRIOR ART
FIG. 7B is a flowchart illustrating an operation of the corona charger in a conventional image forming apparatus.

(Operation of Conventional Corona Charger 2) FIG. 7B is a flowchart illustrating an operation of the corona charger 2 in the conventional image forming apparatus. As illustrated in FIG. 7B, first, when a controller C receives an image forming signal, the controller C confirms an opened and closed state of the shutter 210 by the photo-interrupters 15*a* and 26*a*. When the shutter 210 is in the closed, the driving motor M is driven to open the shutter 210 in step S101. In the state where the shutter 210 is opened, the drum motor D is driven to rotate the photosensitive drum 1 in step S102. In addition, the controller C controls the high voltage power supply S to apply a biasing voltage to the discharge wire 2*h* and the grid 2*a*, to charge the photosensitive drum 1 in step S103.

A toner image is formed on the charged photosensitive drum 1 to perform image formation on the recording material 10 in step S104. After the image formation, the controller C stops the application of the charging bias in step S105, and stops the rotation of the photosensitive drum 1 in step S106. After the rotation of the photosensitive drum 1 is stopped, the controller C reversely rotates the driving motor M to close the shutter 210 in step S107. In addition, even when the closing operation of the shutter 210 is performed immediately after the image formation, the closing operation may be performed after the elapse of a predetermined time from the end of the image formation.

(Cleaning Defect or Image Defect at Time of Opening and Closing of Conventional Shutter 210) According to the control flow described above, the shutter 210 performs the opening and closing operation. Here, the shutter 210 is formed of a soft material including a fiber, and can be wound. In addition, a standard gap between the grid 2*a* and the photosensitive drum 1 is only 1.5 mm, and may be a gap equal to or less than 1.5 mm considering dimensional variation of constituent components. For this reason, when a little loosening or distortion occurs in the shutter 210, the shutter 210 comes in contact with the photosensitive drum 1 or the grid 2*a*.

For this reason, when the opening and closing operation of the shutter 210 is repeatedly performed, fiber naps included in a nonwoven fabric occur on the surface of the shutter 210. The occurring naps are torn off and drop onto the surface of the photosensitive drum 1, when coming in contact with the photosensitive drum 1 or the grid 2*a*.

Here, an observation result of making an observation in a dropping situation and at a dropping place of naps at the time of opening and closing the shutter 210 will be described. As the naps occurring from the shutter 210, there are a single nap and a massive nap in which naps are intertwined to each other, and sizes of most naps are 50 μm to 300 μm. On rare occasions, there are naps larger than 300 μm, and the largest nap of 5,243 collected naps is 2,600 μm. In addition, many naps occur at places in which contact friction with the etching pattern area P of the grid 2*a* occurs. Particularly, many naps occur when the shutter 210 passes through the boundary portions E1 and E2 with the frame of both ends of the etching pattern area P.

In addition, when the shutter 210 is opened, the shutter 210 precedes in a direction of opening the shutter 210, and the grid cleaning member 250 moves to the downstream side of the shutter 210. For this reason, even when the naps occurring from the shutter 210 are attached onto the grid 2*a*, it is possible to remove the naps from the grid 2*a* by the grid cleaning member 250. For this reason, in the opening operation of the shutter 210, the grid cleaning member 250 is provided at the downstream side from the shutter 210 in the movement direction of the opening operation. The naps occurring by the contact friction with the grid 2*a* or the photosensitive drum 1 drop substantially immediately below the corona charger 2. Accordingly, immediately after the shutter 210 is opened, the naps are attached to the position immediately below the corona charger 2 of the photosensitive drum 1.

The naps dropping immediately below the corona charger 2 of the photosensitive drum 1 are conveyed by the driving of the photosensitive drum 1, and are caught at the cleaner blade 6*a* provided in the cleaning device 6. When the naps are caught at the cleaner blade 6*a*, it is difficult to clean the part, and a cleaning defect occurs. Since the toner at the part in which the naps are caught becomes the cleaning defect, it becomes a streak at a white background portion to cause an image defect.

In addition, besides the streak occurrence, when a large nap enters into the developing device 4, the nap is caught at a gap portion formed between a development blade (not illustrated) that is a developer amount restricting unit and the development sleeve 4*a*, and a streak based on nap clogging occurs. In addition, when the nap enters into the developing device 4, there is a problem such as an influence of discharge products such as NOx attached to the nap and discharge inhibition based on discharge characteristics of the nap itself.

Figure 8:
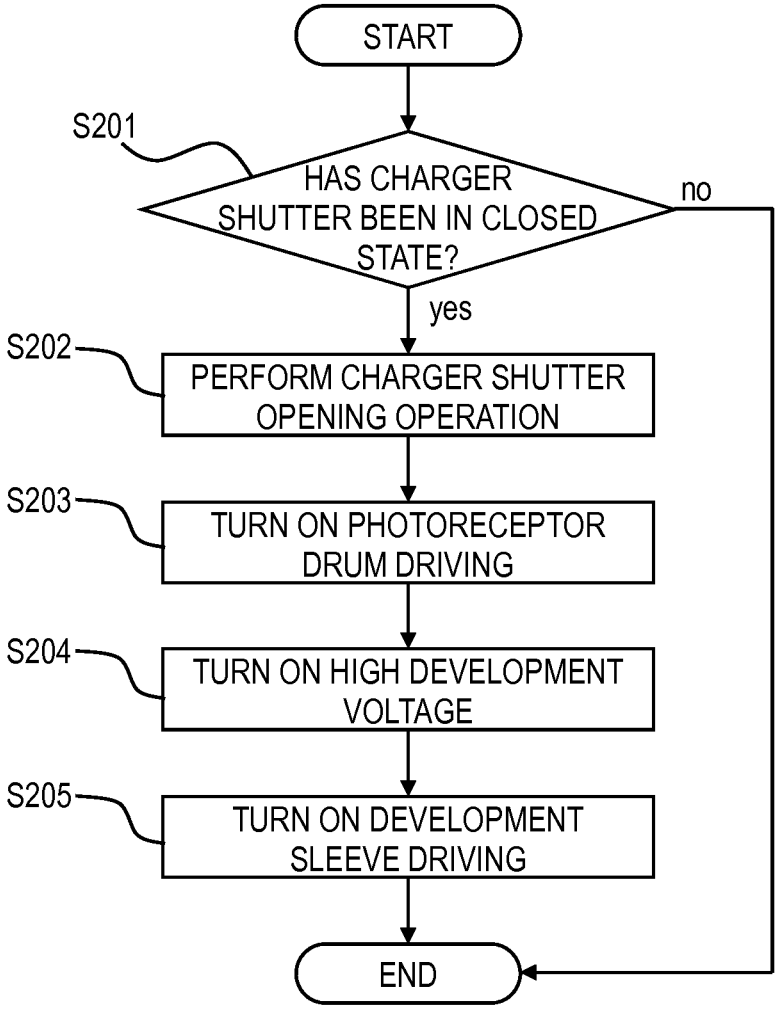
FIG. 8 is a flowchart illustrating a nap countermeasure control at the time of opening and closing the shutter of the first embodiment.

(Countermeasure of Cleaning Defect and Image Defect at Time of Opening and Closing Shutter 210 of Embodiment) Here, in the image forming apparatus 100 of the embodiment, in order to suppress the occurrence of the cleaning defect and the image defect based on the naps, a control flow of FIG. 8 is performed as a preparation operation when starting the image formation. FIG. 8 is a flowchart of a nap countermeasure control when opening and closing the shutter 210 of the embodiment. FIG. 9 is a diagram illustrating movement of a nap Q occurring from the shutter 210 at the time of the control according to the flowchart of FIG. 8.

As illustrated in FIG. 8, first, when power is turned on or an image forming signal is received, the controller C confirms the opened and closed states of the shutter 210 by the photo-interrupters 15*a* and 26*a* in step S201. In step S201, when the shutter 210 is in the opened state, the process is ended at that time point.

Figure 9A:
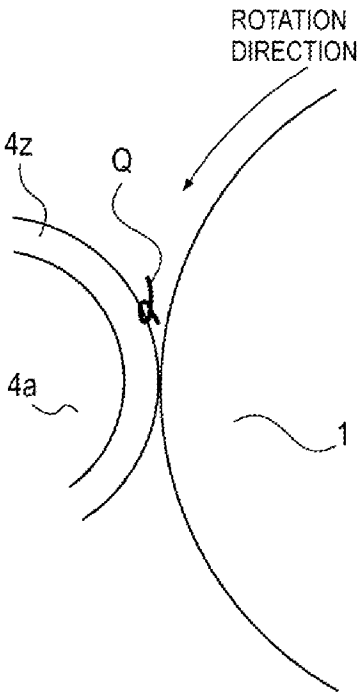
FIG. 9A to FIG. 9C are diagrams illustrating a nap behavior occurring from the shutter of the first embodiment.

In step S201, when the shutter 210 is in the closed state, the driving motor M is driven to open the shutter 210 in step S202. At this time, the nap Q may occur from the shutter 210. In the state in which the shutter 210 is opened, the drum motor D is driven to rotate the photosensitive drum 1 in step S203. When the nap Q is attached onto the photosensitive drum 1, the nap Q is conveyed by the rotation of the photosensitive drum 1 as illustrated in FIG. 9A, and is caught in the vicinity of the development area in which the development sleeve 4*a* in the developing device 4 is close to the photosensitive drum 1. In this case, a high development voltage is applied from the high voltage power supply S to the developing device 4 in step S204. That is, when the area of the photosensitive drum 1 opposed to the corona charger 2 passes through the development area of the photosensitive drum 1 opposed to the development sleeve 4*a* of the corona charger 2, the high development voltage is applied.

Figure 9B:
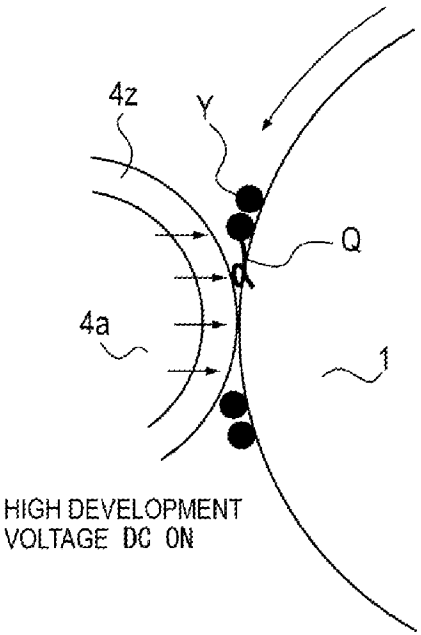

The high development voltage applied to the development sleeve 4*a* of the developing device 4 is applied by −500 V with only a DC component. At the time of general image formation, a high development voltage in which an AC component is overlapped a DC component is applied. In addition, with respect to a white background potential −650 V of the photosensitive drum 1, a DC value of −500 V of the developing device 4 is applied such that a fog removal potential is 150 V. At the timing of S204, since the potential of the photosensitive drum 1 is zero, a potential difference between the development sleeve 4*a* and the photosensitive drum 1 is 500 V, the toner in the developer is developed. In this case, as illustrated in FIG. 9B, the nap Q caught in the vicinity of the development area is pressed to the photosensitive drum 1 side together with the toner.

Figure 9C:
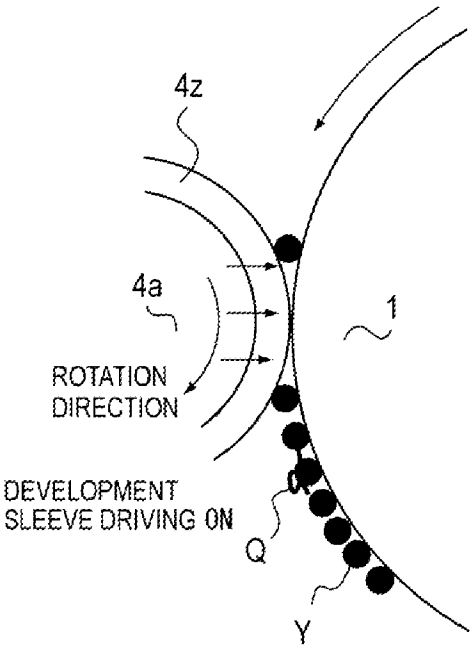

After the application of the high development voltage, the driving of the development sleeve 4*a* is started in step S205. The nap Q pressed to the photosensitive drum side together with the toner more easily passes through the development area by the rotation of the development sleeve 4*a* in addition to the rotation of the photosensitive drum 1. As a result, as illustrated in FIG. 9C, the nap Q is conveyed to the surface of the photosensitive drum 1 together with the toner, and passes through the development area. The nap Q passing through the development area reaches the cleaner blade 6*a* in the cleaning device 6. The toner with a grain diameter of about 6 μm smaller than the size of the nap Q is used, and the nap Q simultaneously reaches the cleaner blade 6*a* together with the toner. For this reason, it is possible to prevent the nap Q from being caught at the cleaner blade 6*a*.

In addition, as a timing of turning on the high development voltage, by turning on the high development voltage before a charging area reaches the development area, a potential difference larger than that at the time of general image formation is formed, and thus it is possible to press the nap Q to the photosensitive drum 1 side together with the toner. Here, the charging area is an area of the photosensitive drum 1 charged by receiving a high charging voltage from the corona charger 2. In addition, after the charging area reaches the development area, even when the high development voltage is turned on, it is possible to obtain the same effect when a high charging voltage is set to a value to form a potential difference larger than that at the time of general image formation.

The high charging voltage which is not illustrated in the flowchart of FIG. 8 may be turned on at the timing before the high development voltage is turned on, and may be turned on after the high development voltage is turned on. In order to reliably suppress the cleaning defect and the image detect based on the nap Q, the time of developing the toner can be long. Accordingly, the development sleeve can be turned on to develop a desired amount of toner and then the high charging voltage can be turned on. That is, since the high charging voltage which is not illustrated in the flowchart of FIG. 8 is turned on until the control of FIG. 8 is ended, it is possible to perform the image forming operation continuously from the end of the control of FIG. 8.

In addition, when rayon is used as a shutter material, a charging line easily becomes minus. Accordingly, when the toner is minus, it is the same polarity, and the nap Q is developed on the photosensitive drum side together with the toner. In addition, even when another material is used as the shutter and has the opposite polarity to the toner, the toner in the vicinity of the development area is developed at once, and thus the nap Q is also developed together with the toner.

The above description is a countermeasure when the nap Q drops at the position of the photosensitive drum 1 opposed to a developer bearing area L2 of the development sleeve 4*a* in the longitudinal direction. However, the nap Q occurs also on the longitudinal outside from the developer bearing area L2. Particularly, many naps Q occur at the boundary portions E1 and E2 between the etching pattern area P and the frame of both ends.

The naps Q occurring at the boundary portions E1 and E2 are not caught in the development as described above, since they are on the outside of the developer bearing area L2. However, even on the outside of the development area, when they are caught at the cleaner blade 6*a*, scratch of the photosensitive drum 1, leak based on the scratch, flapping vibration of the cleaner blade 6*a* by the scratch occurring at the end portion, variation of driving torque of the photosensitive drum 1, and the like occur.

As described above, as illustrated in FIG. 5, the end contact members 6*b* are disposed in the cleaning device 6. The end contact members 6*b* are provided at the upstream in the rotational direction of the photosensitive drum 1 relative to the cleaner blade 6*a*. Longitudinal positions of the end contact members 6*b* are disposed at the positions overlapped the positions of the boundary portions E1 and E2. In addition, the end contact members 6*b* are formed using a pile resin including a fluorine fiber, come in infiltration contact with the photosensitive drum 1 by about 1.0 mm, and are disposed to come in contact with a predetermined contact pressure.

Accordingly, the naps Q occurring at the boundary portions E1 and E2 are conveyed to the end contact members 6*b* by the rotation of the photosensitive drum 1. The naps Q conveyed to the end contact members 6*b* come in contact to intertwine with the pile resin on the surfaces of the end contact members 6*b*, and are dammed on the end contact members 6*b*. Accordingly, it is possible to suppress that the naps Q reach the cleaner blade 6*a*.

When verifying how the longitudinal positions are changed by the dropping position and conveying of the naps Q, the naps Q drop onto the photosensitive drum at the longitudinal positions within 2 mm to left and right from the longitudinal positions of the boundary portions E1 and E2. The naps Q are conveyed by the rotation of the photosensitive drum 1, but the longitudinal positions at the time of conveying are scarcely changed from the dropping positions. Accordingly, it is preferable that the end contact members 6*b* disposed on the upstream of the cleaner blade 6*a* are in the width equal to or more than 2 mm to left and right with respect to the boundary portions E1 and E2. In the embodiment, by providing the end contact members 6*b* overlapping at a width of 15 mm with respect to each of the boundary portions E1 and E2, the naps Q are reliably recovered before reaching the cleaner blade 6*a*.

In addition, it is necessary that the contact portions of the end contact members 6*b* and the photosensitive drum 1 be at least overlapped with the boundary portions E1 and E2 of both ends of the etching pattern area P as viewed in the movement direction of the photosensitive drum 1.

In addition, a sponge formed of urethane such as moltoprene, and a material formed of rubber, as a material of the end contact member 6*b*, also have an effect of recovering the naps Q. In addition, even when the end contact member 6*b* is a brush-shaped member formed of a resin other than the sheet-shaped member, it has the effect of recovering the naps Q. In the case of the end contact member 6*b* of the pile resin including the fluorine fiber described above, when the end contact member 6*b* comes in infiltration contact with the photosensitive drum 1 by about 0.2 mm or more, it is possible to recover the naps Q.

Figure 10:
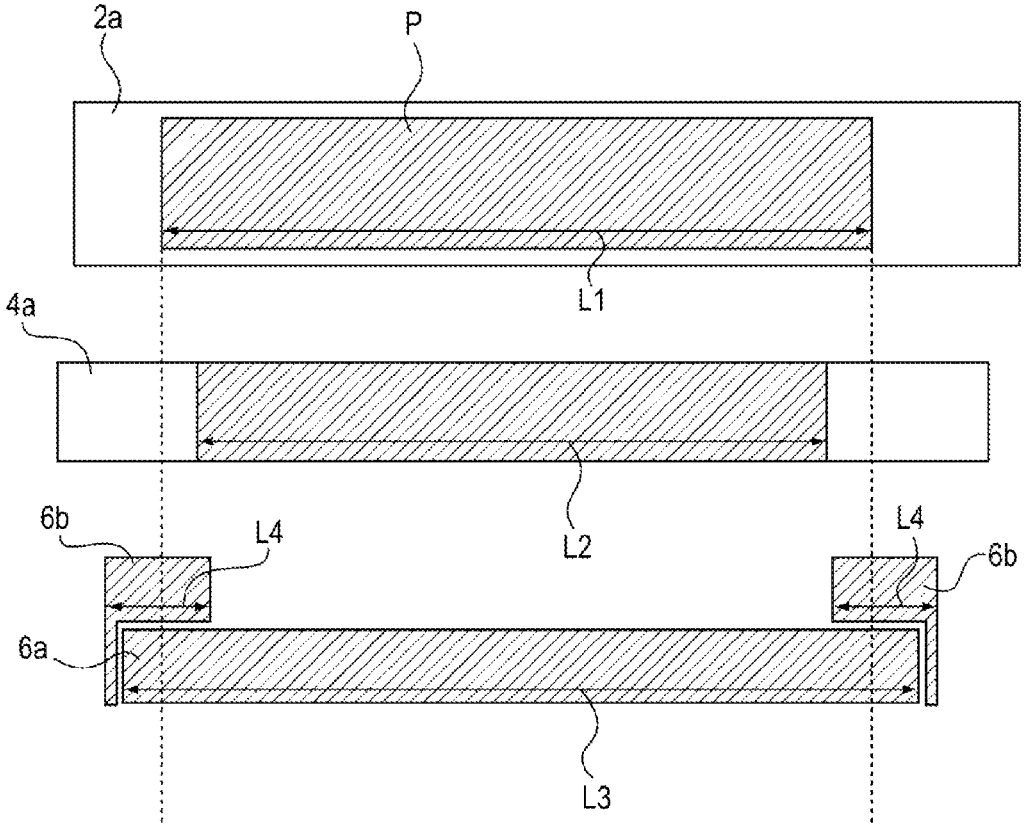
FIG. 10 is a diagram illustrating another shape of an end contact member of the first embodiment.

FIG. 10 is a diagram illustrating another shape of the end contact members 6*b*. As illustrate in FIG. 10, the end contact members 6*b* may have a shape of extending to both longitudinal end portions of the cleaner blade 6*a* as well as on the upstream side in the rotational direction of the photosensitive drum 1 at both end portions of the cleaner blade 6*a*. By the same shape as the end contact members 6*b* illustrated in FIG. 10, it is possible to also serve as end portion seals of the cleaner blade 6*a* as well as the effect of recovering the naps Q. In addition, as the shape of the end contact members 6*b*, in the state of FIG. 5, end portion seals of the cleaner blade 6*a* may be provided as separate members formed of a different material. The shape, material, and contact condition may be appropriately adjusted according to physicality and quantity of the materials such as the toner and the naps coming to the end portion of the cleaner blade 6*a*.

[Second Embodiment] Next, an image forming apparatus according to a second embodiment of the invention will be described with reference to the drawings. The same reference numerals and signs are given to the parts overlapped the description of the first embodiment, and the description thereof is not repeated.

(Endurance Problem of Conventional Image Forming Apparatus) A situation of occurrence of naps Q occurring from the shutter 210 was investigated using the conventional image forming apparatus, and it was known that the occurrence of naps was increased according to increase of the number of endurance times of the shutter 210. That is, in an early stage of the shutter, little naps occurred, and in a later stage of the endurance, occurrence of naps was increased. Specifically, the endurance of performing image formation of 20,000 sheets per day and an opening and closing operation of the shutter at the timing other than the image formation six times was repeated under an environment of a temperature of 26° C. and a humidity of 40%. When the opening and closing operation of the shutter 210 was performed, the number and size of naps dropping onto the photosensitive drum were observed and measured using a microscope.

The number of occurring naps and the size of naps were investigated while repeatedly performing the image formation of 20,000 sheets per day and the operation of performing the opening and closing operation of the shutter 210 six times. As for the size of naps, in the case of a single nap, an approximate nap length was measured using a microscope with a scale, and the nap length was considered as the size of naps. An approximate size of rounded naps was also measured in a found shape. In addition, an approximate size of nap in which a plurality of naps intertwined was measured in an intertwining state.

When image formation was performed from an early stage to 100,000 sheets by repeating the above-described condition, the number of the opening and closing operations (the number of endurance times) of the shutter 210 was 100,000/20,000×6=30. The number of occurring naps observed meanwhile was 32, the size of most naps was 20 to 80 μm, and a calculated average size of the naps was 34 μm. When the number of opening and closing times of the shutter 210 was further increased from it and the number of occurring naps at the number of 270 to 300 times was investigated, the number was increased to 331, and the size of most naps was 60 μm to 180 μm. An average nap size was 120 μm. As described above, it could be found that the number of occurring naps and the size of naps were increased according to the number of opening and closing times of the shutter 210. For this reason, the cleaning defect and the image defect caused by the naps of the shutter 210 easily occur as much as the number of endurance times of the shutter 210 is increased.

(Control of First Embodiment) In the first embodiment, as described with reference to FIG. 8 and FIG. 10, the driving of the photosensitive drum 1 is turned on, the high development voltage is turned on, and then the driving of the development sleeve 4*a* is turned on. More specifically, the time until a charging area reaches the development area after the high development voltage is turned on is assumed to be 200 ms. Here, the charging area is a charged area of the photosensitive drum 1. After the high development voltage is turned on, the driving of the development sleeve 4*a* is turned on after 1,000 ms. That is, the toner is developed from the development sleeve 4*a* to the photosensitive drum side, during a time difference 200 ms until the charging area reaches the development area. This operation is a constant operation which does not depend on the number of opening and closing times of the shutter 210. That is, even when the number of occurring naps is small and the size of naps is small, and even when the number of occurring naps is large and the size of naps is large, there is a countermeasure of developing the naps to the photosensitive drum side using the same control flow. For this reason, it may be a sufficient countermeasure in the state in which the number of opening and closing times of the shutter 210. However, when the number of opening and closing times of the shutter 210 is increased, the number of occurring naps is increased, and thus there is a case in which it is not possible to sufficiently suppress the occurrence of the naps.

Figure 11:
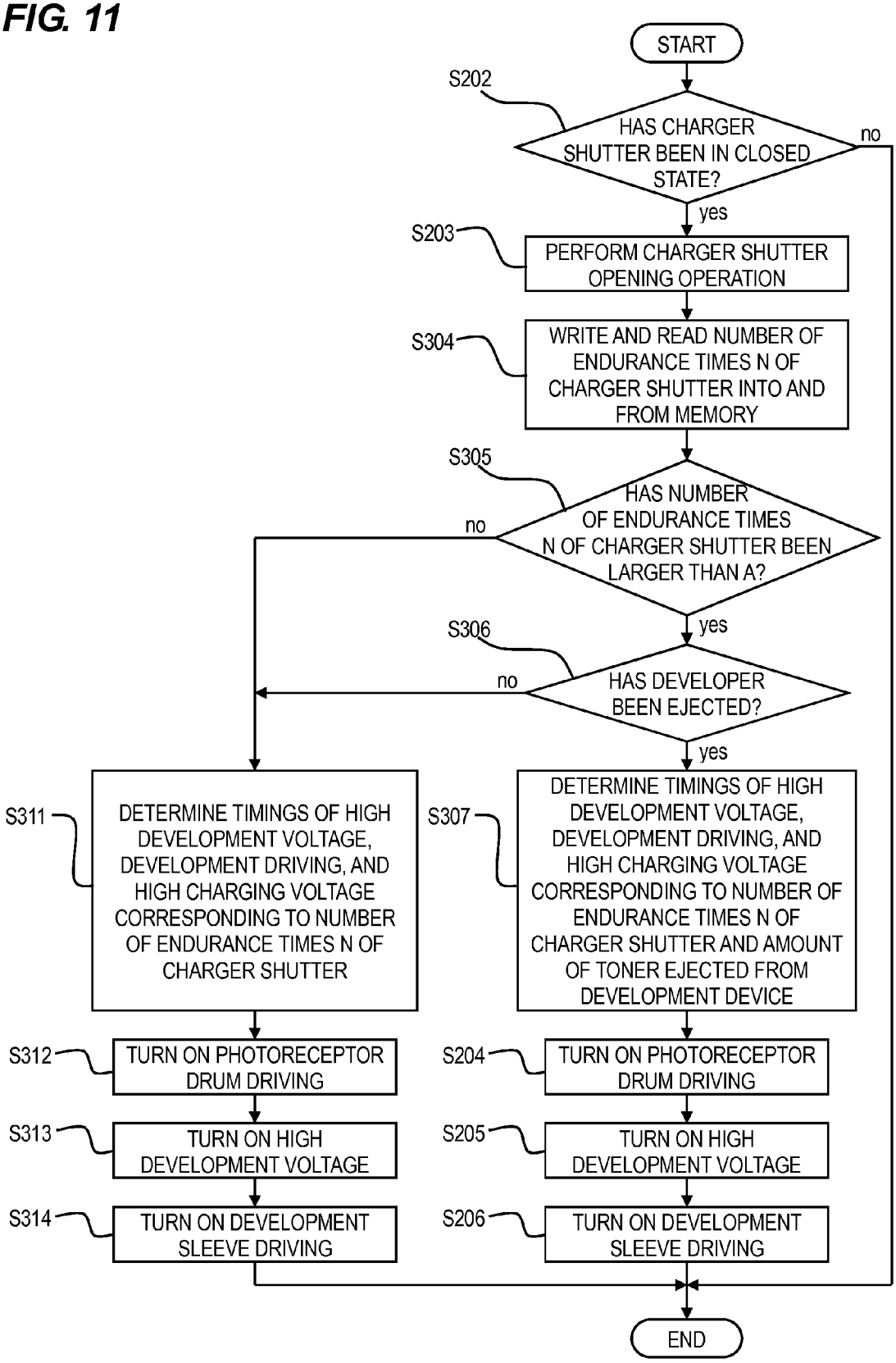
FIG. 11 is a flowchart illustrating a control at the time of a shutter opening and closing operation of a second embodiment.

(Control of Embodiment) In the embodiment, as the observation result described above, in order to cope with the case in which the number and size of occurring naps are different in a state in which the early state and the endurance proceed, in the image forming apparatus 100 of the first embodiment, the timings of the high charging voltage, the high development voltage, and the driving of the development sleeve 4*a* are changed as follows according to the number of opening and closing times of the shutter 210. FIG. 11 is a flowchart illustrating a control at the time of the shutter opening and closing operation of the embodiment.

As illustrated in FIG. 11, in the image forming apparatus of the embodiment, similarly to that of the first embodiment, the control from the confirmation of the opened and closed state of the shutter 210 in step S201 to the control of rotating the photosensitive drum 1 in step S203 are performed. In the embodiment, the number of endurance times N of the shutter 210 is written into a memory, and the latest data is read in step S304. The number of endurance times of the shutter 210 is counted as once when the closing operation and the opening operation are performed. It is compared whether the latest number of endurance times N of the shutter 210 read in S304 is larger than a threshold value A in step S305. In the case of the number of endurance times N of the shutter 210 is not larger than the threshold value A, it is compared with data stored in advance in a database DB of the controller 9, and the timing of driving the development sleeve 4*a*, the timing of turning on the high charging voltage, and the timing of turning on the high development voltage are determined according to the number of endurance times N of the shutter 210 in step S311.

Specifically, when the number of endurance times of the shutter 210 is less than 50, similarly to that of the first embodiment, the driving of the photosensitive drum is turned on in step S312, and the time until the charging area reaches the development area after the high development voltage is turned on in step S313 is assumed to be 200 ms. The high development voltage is turned on, and then the driving of the development sleeve 4*a* is turned on after 1,000 ms in step S314.

When the number of endurance times of the shutter 210 is equal to or more than 200, the driving of the photosensitive drum is turned on in step S312, and the time until the charging area reaches the development area after the high development voltage is turned on in step S313 is assumed to be 500 ms. The high development voltage is turned on, and then the driving of the development sleeve 4*a* is turned on after 1,000 ms in step S314.

That is, according to the number of endurance times of the shutter 210, after the high development voltage is turned on, the time until the charging area reaches the development area is gradually increased from 200 ms. As a calculation formula, the time until the charging area reaches the development area after the high development voltage is turned on, i.e. the time=200 ms+1.5 ms×the number of shutter opening and closing times is calculated. Using the time calculated from the calculation formula, the high development voltage and the high charging voltage are controlled.

By increasing the time until the charging area reaches the development area after the high development voltage is turned on, the amount of toner developed on the photosensitive drum side is increased, and thus it is possible to further press the naps to the photosensitive drum side. As described above, by changing the time, it is possible to reliably press the naps to the photosensitive drum side even when the number of naps is increased.

In addition, when the number of endurance sheets is equal to or more than 300, the driving of the photosensitive drum is turned on in step S312, and the time until the charging area reaches the development area after the high development voltage is turned on in step S313 is assumed to be 1,000 ms. The high development voltage is turned on, and then the driving of the development sleeve 4*a* is turned on after 600 ms in step S314. By the change, the development of the toner is performed in 1,000 ms until the charging area reaches the development area, the development sleeve 4*a* is driven during the later 400 ms thereof, and the naps are developed to the photosensitive drum side while developing the toner. It is possible to attach the naps attached in the vicinity of the development area to the photosensitive drum together with the toner without mixing into the developing device.

By conveying the naps together with the toner to the cleaner blade 6*a* of the photosensitive drum 1, it is possible to recover the naps by the cleaner blade 6*a* without nipping between the cleaner blade 6*a* and the photosensitive drum 1. Particularly, when the developer is ejected, a large amount of toner ejected from the developing device 4 comes to a contact portion of the cleaner blade 6*a* and the photosensitive drum 1, and it is possible to lower probability that the naps themselves are caught at the cleaner blade 6*a*.

Meanwhile, in the case that the number of endurance times N of the shutter 210 is larger than the threshold value A in step S305, it is confirmed whether to perform an ejection control of the developer for preventing deterioration of the developer at the next time in step S306. In step S306, when it is determined that the ejection operation of the developer is not performed, the control of steps S311 to S314 described above is performed.

In step S306, when it is determined that the ejection operation of the developer is performed, a potential difference between the potential of the photosensitive drum 1 and the high development voltage and a time of forming the potential difference are calculated from the number of endurance times N of the shutter 210 and the ejection amount of the development toner using a table or a calculation formula illustrated in FIG. 12A stored in advance in the database DB, and the timings of the high development voltage, the driving of the development sleeve 4*a*, and the high charging voltage are determined in step S307.

Specifically, the potential difference 500 V and 150 ms are calculated from the ejection amount of the development toner. In that case, the driving of the photosensitive drum 1 is turned on in step S308, the high development voltage −500 V is turned on before 200 ms when the area of the charging area −650 V reaches the development area in step S309, and the driving of the development sleeve 4*a* is turned on after 50 ms thereof in step S310. After the high development voltage is turned on in step S309, 50 ms is taken until it is stabilized to the set −500 V, the driving of the development sleeve 4*a* is turned on from the state where the high development voltage is stabilized to −500 V, and thus the ejection of the toner is performed in 150 ms in the state in which the potential difference between the photosensitive drum 1 and the high development voltage is −500 V. After the lapse of 150 ms after the driving of the development sleeve 4*a* is turned on, the charging area reaches a development sleeve opposed portion (the development area), and the same kind of fog removal potential −150 V as that at the time of the image formation is kept. In addition, the calculation of the ejection amount of the development toner is determined considering the time until the high development and charging voltages and rising and falling of the driving of the development sleeve are stabilized.

As described above, when the ejection control of the developer is performed to prevent the deterioration of the developer, a predetermined amount of toner is ejected using the control flow from step S307 to step S310 at the ejection timing, the naps are pressed to the photosensitive drum side together with the ejected toner, and thus it is possible to further prevent the cleaning defect and the image defect based on the naps. Accordingly, the ejection operation of the toner performed by post-rotation after the image formation completion or between the sheets in the course of the image formation is also used as a nap countermeasure control flow. By commonly using the ejection and the nap countermeasure control, it is possible to achieve both of a nap countermeasure and down-time reduction of the apparatus.

In addition, the reason why the timing of turning on the high charging voltage is not described in the flowchart of FIG. 11 is that the high charging voltage is turned on according to the timing determined in step S311 or S307 based on the data of the database DB as described above. Specifically, the timing of turning on the high charging voltage may be between steps S312 and S313, between steps S313 and S314, or after step S314.

(Test) Actually, a test of transition of the cleaning defect, the image defect, and the image streak based on the naps, the end portion surface of the photosensitive drum was performed together with transition of the number of occurring naps of the embodiment, as compared with the conventional example. FIG. 12B is a diagram illustrating the naps with respect to the number of opening and closing times of the shutter 210 and the endurance transition of the cleaning defect and the image detect based on the naps in the conventional example, and the first and second embodiments. As illustrated in FIG. 12B, it could be known that the number of occurring naps is increased, and the average size of the naps is increased, as much as the number of opening and closing times of the shutter is increased.

As well as the occurrence situation of the naps, when the naps are caught at the cleaner blade 6*a* of the photosensitive drum 1, a streak occurs on the image. Accordingly, a whole-face halftone image was output for every 20,000 sheets, and it was confirmed whether there is a streak on the image. As for the streak on the image, a density was measured using a reflection-type densitometer manufactured by X-Rite, Incorporated., a streak in which a density difference between the density of the streak portion and the density other than the streak was equal to or more than Δ0.03 was evaluated as "no good" (as indicated by "×"), a streak in which a density difference was Δ0.015 to 0.029 was evaluated as "not bad" (as indicated by "Δ"), and a streak in which a density difference was less than Δ0.015 was evaluated as "good" (as indicated by "○"), which are illustrated in FIG. 12B.

As described above, the amount of naps around the etching pattern boundary portions E1 and E2 of the grid 2*a* is large, and the naps are caught at the cleaner blade 6*a*. The caught naps cut the photosensitive drum surface. In addition, as a confirmation indicator, a cleaning state of the photosensitive drum surface at a place corresponding to the charging etching pattern boundary portions E1 and E2 of the grid 2*a*, a surface state of the photosensitive drum 1, a surface roughness, a cutting amount, and the like were confirmed for every 20,000 sheets.

In the conventional configuration, the photosensitive drum surface at the longitudinal positions of the charging etching pattern boundary portions E1 and E2 of the grid 2*a* became a streak shape from the vicinity of the time when the number of opening and closing times of the shutter 210 was over 90, and the scattered toner or the like became a cleaning defect state. The number of endurance times of the shutter 210 was further increased, and the larger amount of toner became the cleaning defect state from about 150 times. The cleaning defect toner is attached to the photosensitive drum 1, or is attached to peripheral parts. Such toner causes toner scattering in the image forming apparatus, an operation defect by penetration of the toner into a sliding portion of a sliding component, a toner stain of replacement parts, and the like.

Accordingly, in the conventional example, from the time when the number of opening and closing times of the shutter was over 90, the cleaning defect toner was scattered, and was piled up on the parts around the photosensitive drum, and the piled toner dropped onto the image sometimes, to generate a stain on the image. In addition, a minor image streak occurred from the time when the number of opening and closing times of the shutter 210 is 150, and it was considered as NG to be viewed as more visible image flow from the time when the number of opening and closing times of the shutter was equal to or more than 150.

In the first embodiment, the minor image streak occurred from the time when the number of opening and closing times of the shutter 210 was 330, but the image evaluated as "no good" (as hereinafter referred to "NG") did not occur. In the second embodiment, the image streak did not occur until the number of endurance times of the shutter 210 was 390, and it could be confirmed that the endurance was more satisfactory than the first embodiment.

Again, describing an effect by converting the result described above into the number of endurance sheets not the number of opening and closing times of the shutter 210, the number in the convention example is 150/6×20,000=500,000, which is NG. In the first embodiment, there is no definite NG, but a minor NG image occurs from the vicinity of 330/6×20,000=1,100,000. In the second embodiment, there is no NG image up to 390/6×20,000=1,300,000. From the above description, as compared with the convention example, it could be confirmed that it is possible to reduce the occurrence of the image defect by the configurations of the first embodiment and the second embodiment.

Figure 13:
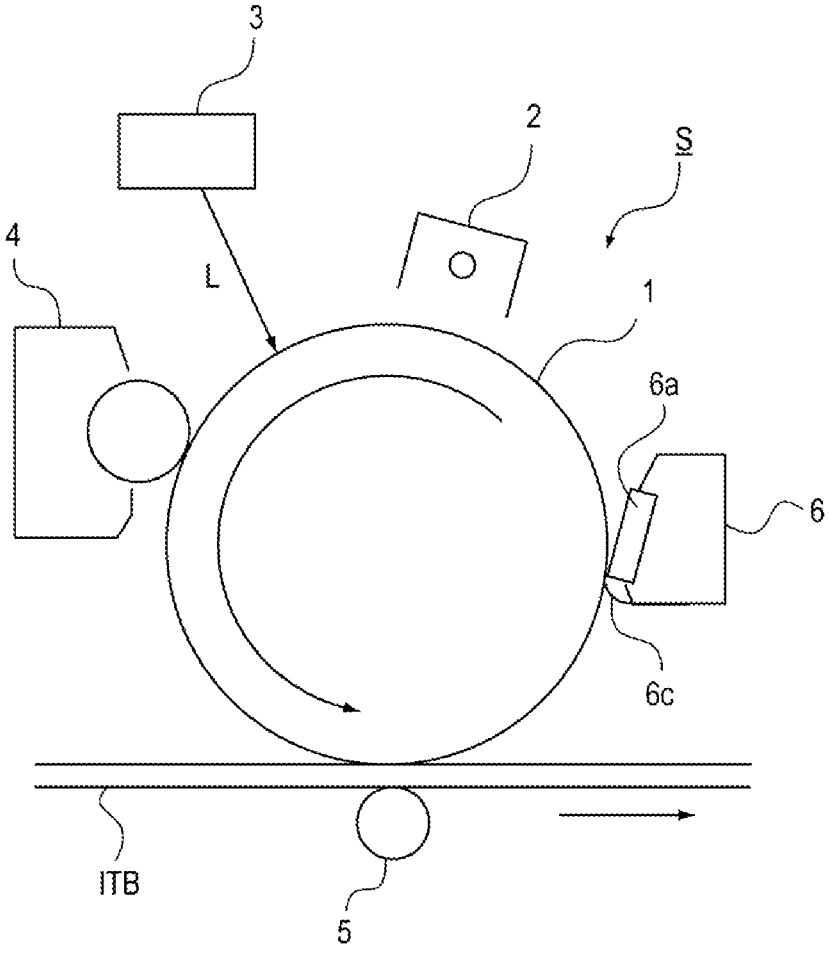
FIG. 13 is a diagram illustrating a configuration of an image forming portion in a third embodiment.

[Third Embodiment] Next, an image forming apparatus according to a third embodiment of the invention will be described with reference to the drawings. The same reference numerals and signs are given to the parts overlapped the description of the first embodiment, and the description thereof is not repeated. FIG. 13 is a diagram illustrating a configuration of an image forming portion in the embodiment.

As illustrated in FIG. 13, in the image forming apparatus 100 of the embodiment, the image forming apparatus 100 of the first embodiment is provided with a sheet member 6*c*. The sheet member 6*c* comes in contact with the whole rectangular area of the photosensitive drum 1 on the upstream side in the rotational direction of the photosensitive drum of the cleaner blade 6*a* in the cleaning device 6.

The sheet member 6*c* is a sheet made of urethane with a thickness of 120 μm, a surface of which is wrinkle-processed, and is attached to a frame of the cleaning device 6 with a rectangular width of 370 mm. In addition, the sheet member 6*c* is disposed to be infiltrated from the outermost surface of the photosensitive drum by 1.0 mm, at an angle of 75° with respect to the upstream side in the rotational direction of the photosensitive drum 1 in a tangent line of the photosensitive drum surface.

As described in the first and second embodiments, probability that the naps transferred to the cleaner blade 6*a* together with the toner are caught at the cleaner blade 6*a* is low. However, it is preferable that the naps do not reach the cleaner blade 6*a* as possible. Particularly, as described in the second embodiment, the size of the naps is increased when the endurance proceeds, and thus it is possible to further reduce the probability of reaching the cleaner blade 6*a*. In the embodiment, the sheet member 6*c* is disposed on the upstream of the cleaner blade 6*a*, to have an effect of removing the naps by the sheet member 6*c*. The size of naps is equal to or more than 20 μm and is larger than the toner grain diameter of 6 μm, a force of being attached to the photosensitive drum 1 is weaker than that of the toner. For this reason, as for the sheet member 6*c*, by considering the contact method described above and a material of the sheet, it is possible to remove the naps, the attaching force of which is weaker than that of the toner without scraping the remaining transfer toner.

By disposing the sheet member 6*c*, it is possible to reduce the number of naps reaching the cleaner blade 6*a* of the photosensitive drum 1, and thus it is possible to reliably suppress the cleaning defect and the image defect based on the naps. In addition, when a material having a charging polarity of the opposite polarity to that of the naps of the shutter 210 is used as a material of the sheet member 6*c*, it can be easy to absorb the naps in an electrostatic manner.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-191945, filed Aug. 31, 2012, which is hereby incorporated by reference herein in its entirety.

What is claimed is:

1. An image forming apparatus comprising:

a photosensitive member that is rotatable;

a charger includes a discharge electrode, a case surrounding the discharge electrode and having an opening on the photosensitive member side, and a grid disposed in the opening and having a mesh area inside thereof, and charges the photosensitive member at a charging portion;

a shutter having a sheet-shape is disposed closer to the photosensitive member than the grid, includes a fiber, and opens and closes the opening;

a moving mechanism moves the shutter in a longitudinal direction of the grid to be opened and closed;

an exposure device exposes the photosensitive member charged by the charger;

a developing device develops an electrostatic latent image formed on the photosensitive member by the exposure device, with toner;

a transfer device transfers a toner image formed on the photosensitive member by the developing device to a transfer medium at a transfer portion;

a blade is disposed on a downstream side of the transfer portion and an upstream side of the charging portion with respect to a rotational direction of the photosensitive member, and comes in contact with the photosensitive member to remove the toner remaining on the photosensitive member; and first and second contact members are disposed on a downstream side of the charging portion and an upstream side of a contacting portion of the blade with respect to the rotational direction of the photosensitive member, and come in contact with areas of the photosensitive member corresponding to both longitudinal ends of the mesh area, and the first and second contact members contact an upstream side of the contacting portion of the blade and the photosensitive member with respect to the rotating direction of the photosensitive member.

2. The image forming apparatus according to claim 1, wherein each of the first and second contact members are disposed to come in contact with the photosensitive member outside a maximum range in which the toner image is formed in a rotational axis direction of the photosensitive member.

3. The image forming apparatus according to claim 1, wherein the first and second contact members are members including a fiber.

4. The image forming apparatus according to claim 1, wherein the blade and the first and second contact members are provided in a cleaning device that removes and recovers the toner remaining on the photosensitive member from the photosensitive member.

5. The image forming apparatus according to claim 1, wherein the shutter is a nonwoven fabric.

6. The image forming apparatus according to claim 1, wherein contact pressure of the first and second contact members to the photosensitive member is lower than contact pressure of the blade to the photosensitive member.

7. The image forming apparatus according to claim 1, wherein the first and second contact members have a portion that contacts the photosensitive member at an outer portion of both ends of the blade in the longitudinal direction.

* * * * *